US007179240B2

(12) United States Patent
Wu

(10) Patent No.: US 7,179,240 B2
(45) Date of Patent: Feb. 20, 2007

(54) PUSH KNEADING DEVICE OF MASSAGER

(76) Inventor: Dong-Her Wu, No.141, Sec. 2, Chang Shui Road, Pu Yen Hslang, Chang Hua Hsien (TW)

( * ) Notice: Subject to any disclaimer, the term of this patent is extended or adjusted under 35 U.S.C. 154(b) by 0 days.

(21) Appl. No.: 11/184,883

(22) Filed: Jul. 20, 2005

(65) Prior Publication Data

US 2007/0021695 A1 Jan. 25, 2007

(51) Int. Cl.
*A61H 19/00* (2006.01)

(52) U.S. Cl. ..... 601/99; 601/100; 601/101

(58) Field of Classification Search ..... 601/22, 601/27–31, 46, 49, 50, 61, 70, 86, 87, 95, 601/134
See application file for complete search history.

(56) References Cited

U.S. PATENT DOCUMENTS 5,807,288 A * 9/1998 Wu ..... 601/99
5,877,570 A * 3/1999 Chen ..... 310/75 R
5,971,944 A * 10/1999 Chang ..... 601/90
6,083,180 A * 7/2000 Shimizu ..... 601/50
2005/0245851 A1* 11/2005 Ferber et al. ..... 601/86

* cited by examiner

*Primary Examiner*—Michael A. Brown
(74) *Attorney, Agent, or Firm*—Troxell Law Office, PLLC

(57) ABSTRACT

This invention relates to a push kneading device of massager which is composed of main base and driving motor, worm rod, worm gear wheel and massage body fixed inside this main base, wherein, one set of driving motor with worm rod at one terminal and two worm gear wheels geared up with worm rod are fixed inside the main base; and the limiting transmission shafts are respectively installed on the protruding positions of offset of worm gear wheel, two pivot rods are also fixed respectively corresponding to the center of worm gear wheel in the proper position of main base; massage surfaces are fixed on the top side of massage body with one locating hole and long runner at its bottom; thereby, to connect locating hole and long runner of massage body respectively with limiting transmission shaft and pivot rod, the worm gear wheel may generate rotation by use of running position of long runner and locating hole that may make massage body move up-and-down repeatedly and vibrate to left and right so as to provide push finger pressing massage and kneading as hands of human.

6 Claims, 4 Drawing Sheets

PUSH KNEADING DEVICE OF MASSAGER

BACKGROUND OF THE INVENTION

1) Field of the Invention

This invention relates to a push kneading device of massager which has improved the ordinary massager that only kneads a single part of body; in which, the driving motor drives worm rod and the geared worm gear wheel so as to run the locating hole to rotate synchronously by limiting axis, and the long runner may slide freely under support of pivot rod, therefore, the massager may make up-and-down motion repeatedly and vibrate to left and right, especially, it has finger pressing massage as hands of human, meanwhile, it can massage large parts of body while kneading.

2) Description of the Prior Art

Usually, the small massager or massage chair that massages neck utilizes worm rod and wheel to generate transmission, its production and machining are difficult and also waste lots of time due to the complicated components of its whole structure, furthermore, it has higher production cost. In addition, such structure makes use of ball massage body so that it can only massage the point of contact, therefore, the size to be massaged is not big and its massage effect is not good as required; due to its small areas of contact and force, so that the reverse pressure borne by user cannot be dispersed, it is easy to produce sore during massaging, therefore, it is not practical and required to get improved further.

SUMMARY OF THE INVENTION

Due to the shortcomings of above said structure of massager, the inventors of this invention have succeeded in developing this invention that can totally get rid of these shortcomings in the production and application of lifting massager based on hard efforts and lots of testing and modifications. In which:

The main purpose of this invention is to provide an improved kneading massager which has improved structure of ordinary massager that can only knead a single part of body; It mainly makes use of driving motor to drive worm rod and geared worm gear wheel so as to run the locating hole to rotate synchronously by limiting axis, and the long runner may slide freely under support of pivot rod, therefore, the massager may make up-and-down motion repeatedly and vibrate to left and right, especially, it has finger pressing massage as hands of human, meanwhile, it can massage large parts of body while kneading.

The second purpose of this invention is to provide an improved kneading massager; wherein it may massage large parts of body by repeating up-and-down movement and left & right vibration of the massager so that the contact and force points of massage body are changing from time to time, therefore, it has excellent practical efficiency that the user does not feel any sore while massaging.

The third purpose of this invention is to provide an improved kneading massager; wherein this case utilizes pivot limiting axis of locating hole and the pivot rod of long runner to make movement (rotation or running position) based on pivot point, such movement is so simple that may not generate any interference between them, so it can provide a stable operation.

The fourth purpose of this invention is to provide an improved kneading massager, wherein the top side massage surface of massage body, the rotating roller to rotate in fixed axis is installed on the top side of massage surface and provide roll and pressing of rotating roller, so that it can massage you perfectly.

DETAILED DESCRIPTION OF THE PREFERRED EMBODIMENTS

Figure 1:
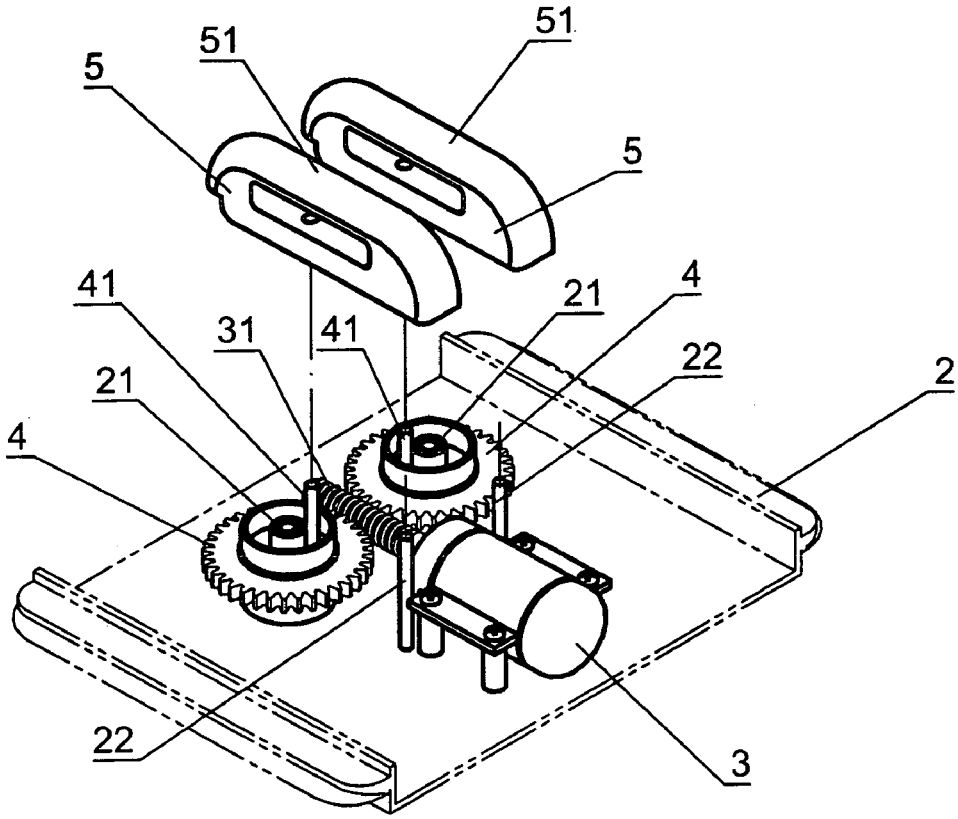
FIG. 1 is a cubic exploded view of this invention
Figure 2:
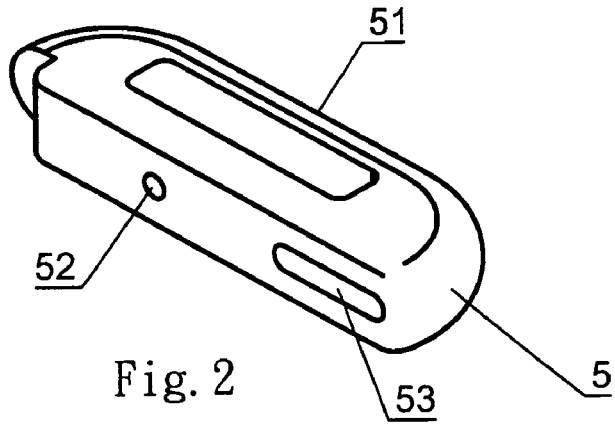
FIG. 2 is an appearance view of massage body of this invention
Figure 3:
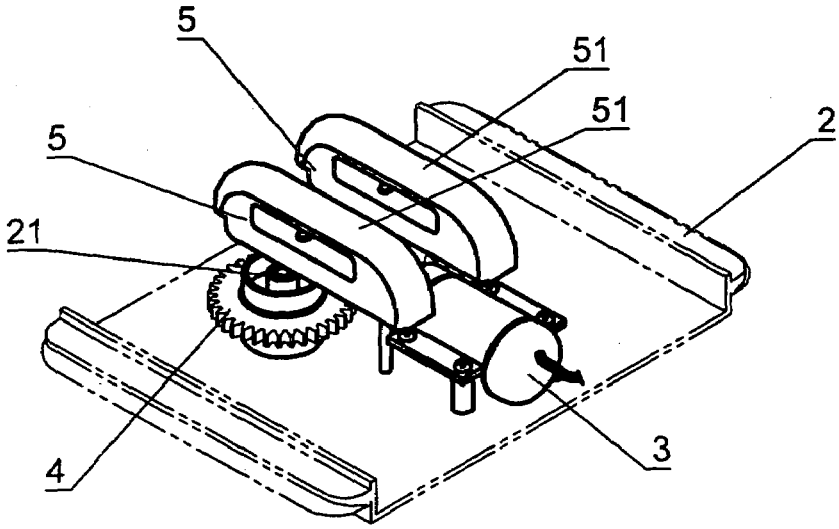
FIG. 3 is a sketch map of cubic combination of this invention

First of all, please refer to FIG. 1, FIG. 2 and FIG. 3: this invention is composed of main base 2, driving motor 3, worm gear wheel 4 and massage body 5; in which:

Main base 2, in which, a pair of opposite positioning posts 21 and two pivot rods 22 corresponding to center of positioning posts 21 respectively are fixed;

One set of driving motor 3 which is installed in main base 2, its driving axis end fixes worm rod 31.

Two worm gear wheels 4 are fixed at the positioning posts 22 of main base and gear up with worm rod 31 of the driving motor to generate transmission, one limiting transmission shaft 41 is respectively fixed at offset of worm gear wheel;

Two massage bodies 51, massage surface 51 is fixed on top side of each massage body 5, its bottom has one locating hole 52 and long runner 53 (see FIG. 2 for detail);

Thereby, to conceal the linked-running worm rod 31 and worm gear wheel 4 inside main base, then connect the limiting transmission shaft 41 of worm gear wheel with locating hole 52 of massager 5, however, the long runner 53 is to connect with pivot rod 22 so as to assemble a device with kneading effect (refer to FIG. 3).

Figure 4:
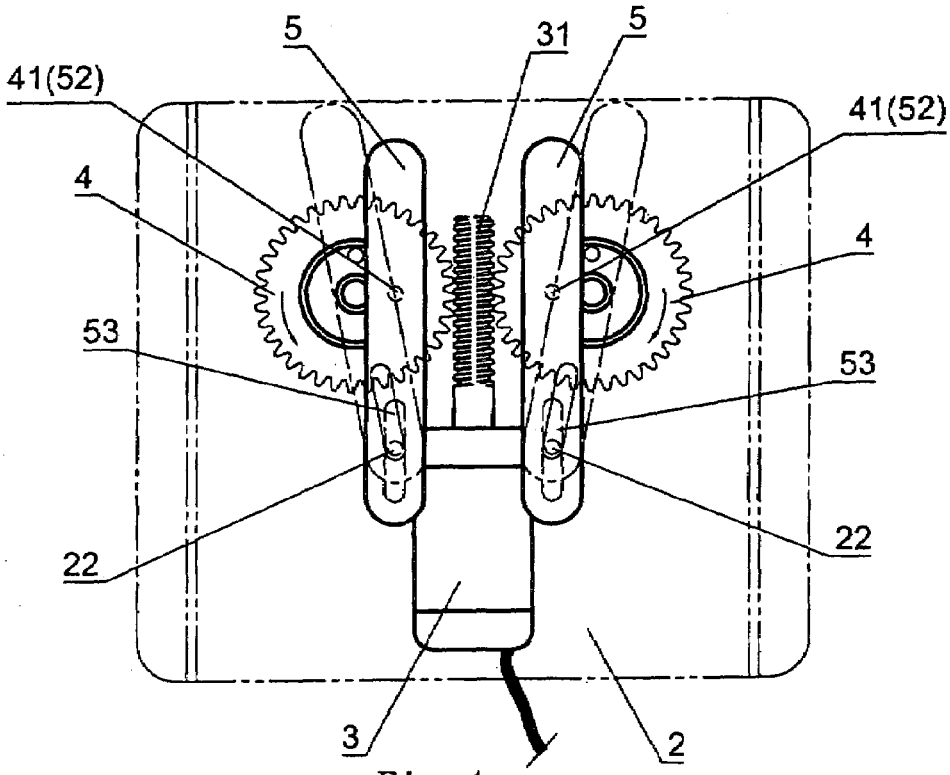
FIG. 4 is a running sketch map of combination of this invention
Figure 5:
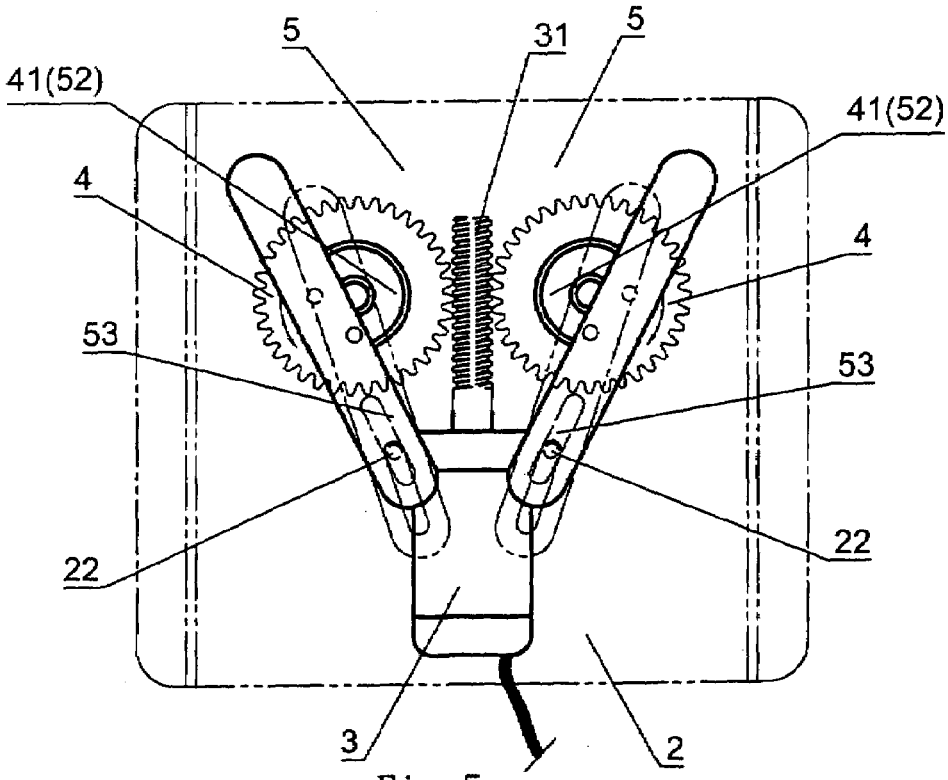
FIG. 5 shows another running sketch map of combination of this invention

Please again refer to FIG. 4 and FIG. 5, when driving motor 3 drives dynamic driving worm rod 31 to rotate, which may gear up with worm gear wheel 4 to rotate in different direction so that the locating hole 52 connecting with limiting transmission shaft 41 rotates after it, the displacement may make the long runner 53 restrict the running position of pivot rod 22, based on these operations, massage body 5 can make up-&-down motion repeatedly and vibrate to left and right (it generates continuous rotation in different direction), its massage surface 51 may make the push finger pressing massage and kneading as well like hands of human on the function side of massager (shown as FIG. 4 and FIG. 5).

Figure 6:
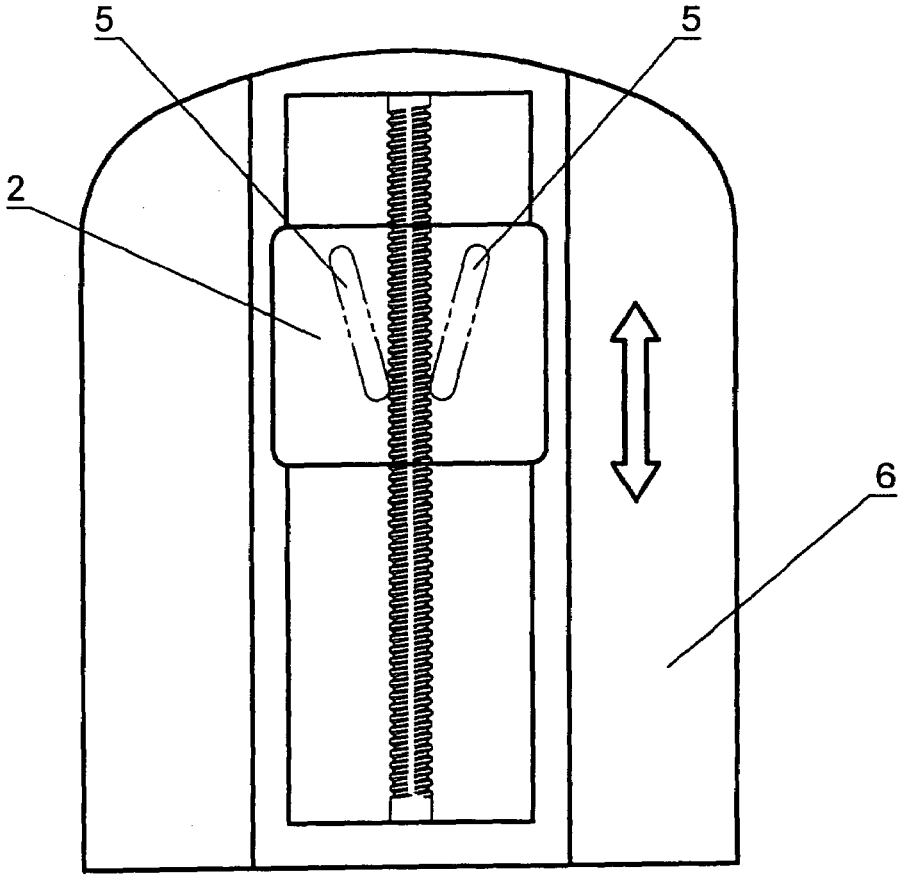
FIG. 6 is a legend to assemble massage device of this invention
Figure 7:
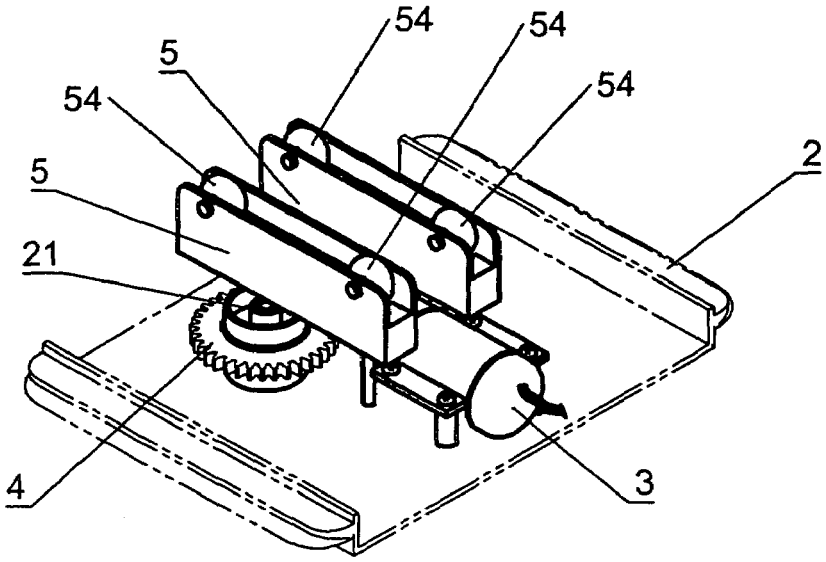
FIG. 7 is a cubic combination sketch map of another legend
Figure 8:
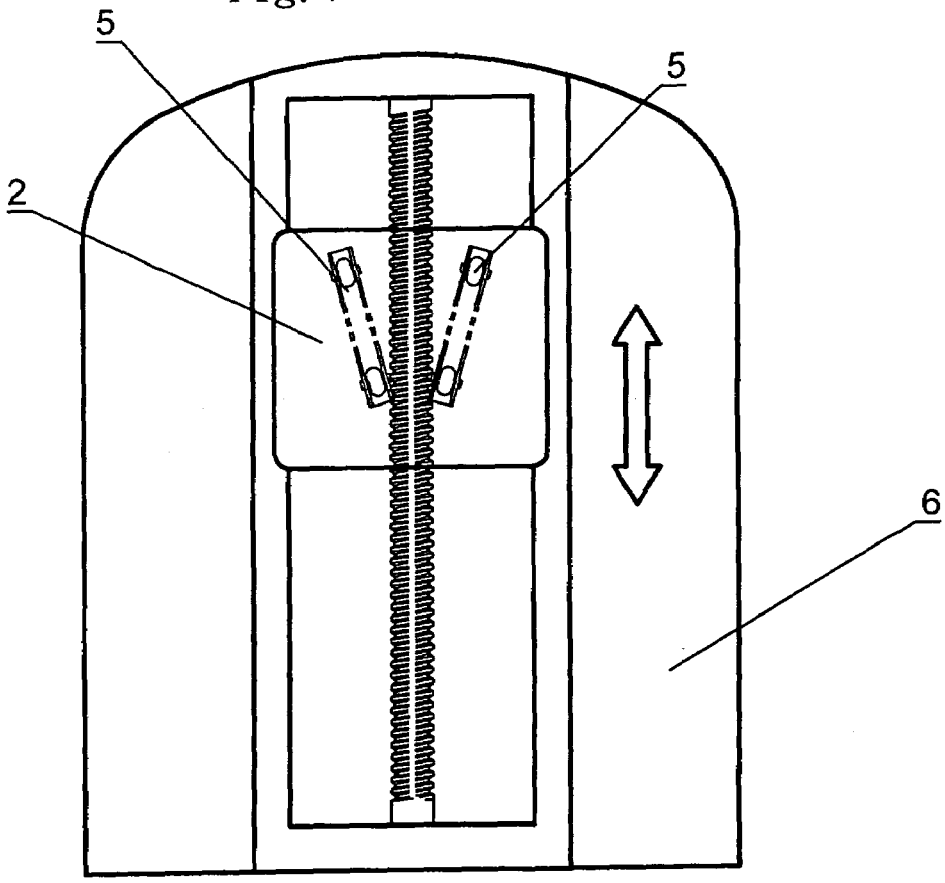
FIG. 8 shows another executive legend to assemble massage device of this invention

Furthermore, the massage surface 51 on top side of the massage body is fixed as arc (shown as FIG. 1, FIG. 3 and FIG. 6) to provide direct contact pressing massage, also the rotating roller 54 that rotates with fixed axis is installed at the top side, which can provide rolling, finger pressing by rotating roller 54, that will give you favorable massage effect (shown as FIG. 7 and FIG. 8).

In addition, the device of this invention can be used for single portable or fixing massage device, it can also be assembled with seat or chair massage device 6 as its accessory component; To combine the carrying belt and control of driving equipment fixed on massage device 6 with device of this invention can make long distance displacement and push kneading, that will massage a larger parts of body and thereof result in more comfortable and creative effect (refer to FIG. 6).

To sum up all above descriptions, this invention can reach the predictable target based on this structure, and also has greatly improved the ordinary massager that only has rotating and vibrating movement, therefore, this invention has met the requirements as new patent, it is hereby specially to submit the application for patent in accordance with law, earnestly adjure your office to authorize us the patent of this invention, your kindness will be highly appreciated!

What is claimed is:

1. A push kneading device of a massager comprising:

a) a main base having two positioning posts and two pivot rods protruding upwardly;

b) a driving motor having a worm rod;

c) two worm gear wheels engaging and driven by the worm rod, each of the two worm gear wheels having a limiting transmission shaft protruding upwardly, one of the two worm gear wheels is rotatably connected to one of the two positioning posts; and d) two massage bodies controlled by a movement of the two worm gear wheels, each of the two massage bodies having:

i) a locating hole, the limiting transmission shaft of one of the two worm gear wheels is inserted into locating hole of each of the two massage bodies; and ii) a runner, one of the two pivot rods is slidably inserted into the runner of each of the two massage bodies.

2. The push kneading device according to claim 1, wherein each of the two massage bodies has an arc shaped massage surface.

3. The push kneading device according to claim 1, further comprising a plurality of rotating rollers, each of the two massage bodies has a massage surface, at least one of the plurality of rotating rollers is located on the massage surface of each of the two massage bodies.

4. The push kneading device according to claim 1, wherein the push kneading device is used as a single massager.

5. The push kneading device according to claim 1, wherein the push kneading device is used as an accessory component.

6. The push kneading device according to claim 1, wherein the locating hole and the runner are located on opposing ends of each of the two massage bodies.

* * * * *